US009863163B2

(12) United States Patent
Lonergan et al.

(10) Patent No.: US 9,863,163 B2
(45) Date of Patent: Jan. 9, 2018

(54) SLED-ATTACHED ICE SHELTER WITH FLEXIBLE AND RIGID POLE STRUCTURE

(71) Applicant: Ardisam, Inc., Cumberland, WI (US)

(72) Inventors: Brendan P. Lonergan, Cumberland, WI (US); Trevor R. Kinderman, Cumberland, WI (US); David E. Hare, Comstock, WI (US); David J. Lynch, Comstock, WI (US)

(73) Assignee: Ardisam, Inc., Cumberland, WI (US)

( * ) Notice: Subject to any disclaimer, the term of this patent is extended or adjusted under 35 U.S.C. 154(b) by 0 days.

(21) Appl. No.: 15/058,992

(22) Filed: Mar. 2, 2016

(65) Prior Publication Data

US 2016/0258179 A1 Sep. 8, 2016

Related U.S. Application Data

(60) Provisional application No. 62/127,171, filed on Mar. 2, 2015.

(51) Int. Cl.

| | |
|---|---|
| ***E04H 15/48*** | (2006.01) |
| ***E04H 15/00*** | (2006.01) |
| ***E04H 15/02*** | (2006.01) |
| ***E04H 15/30*** | (2006.01) |

(52) U.S. Cl.

CPC ..... *E04H 15/001* (2013.01); *E04H 15/02* (2013.01); *E04H 15/30* (2013.01); *E04H 15/48* (2013.01)

(58) Field of Classification Search

CPC ..... E04H 15/02; E04H 15/001; E04H 15/44; E04H 15/48; E04H 15/30; B60P 3/341; B60P 3/32; B60P 3/39

USPC ..... 135/88.1, 88.05, 88.13, 88.15, 96, 135/136–137, 132–133, 148, 151, 135/115–116, 119, 901, 905; 296/156, 296/159–161, 163, 167–168, 172–173, 296/176, 77.1; 280/19.1

See application file for complete search history.

(56) References Cited

U.S. PATENT DOCUMENTS

| | | | | |
|---|---|---|---|---|
| 2,826,210 A * | 3/1958 | Heil | B60P 3/341 | 135/132 |
| 3,810,482 A * | 5/1974 | Beavers | E04H 15/48 | 135/147 |
| 3,968,809 A * | 7/1976 | Beavers | E04H 15/06 | 135/120.3 |
| 4,819,680 A * | 4/1989 | Beavers | E04H 15/48 | 135/119 |
| 4,938,243 A * | 7/1990 | Foster | E04H 15/001 | 135/128 |

(Continued)

*Primary Examiner* — Winnie Yip
(74) *Attorney, Agent, or Firm* — Schwegman Lundberg & Woessner, P.A.

(57) ABSTRACT

A portable ice shelter comprises a base, a rigid frame member, a multi-panel skin and a first set of flexible poles. The base comprises a bottom wall and a sidewall that forms an outer perimeter. The rigid frame member is pivotably mounted to the base at first and second locations, and is moveable between a stored position against the base and a deployed position. angled from the base. The multi-panel skin is coupled to the rigid frame member, the multi-panel skin defining an enclosure when expanded. The first set of flexible poles extend from the rigid frame member, and each of the flexible poles in the first set is connected in an expandable fashion so as to expand at least a portion of the multi-panel skin when the rigid frame member is in the deployed position.

20 Claims, 14 Drawing Sheets

(56) References Cited

U.S. PATENT DOCUMENTS

| | | | | |
|---|---|---|---|---|
| 5,271,423 | A * | 12/1993 | Eychaner | E04H 15/001 135/134 |
| 5,368,057 | A * | 11/1994 | Lubkeman | E04H 15/001 135/133 |
| 7,320,332 | B2 | 1/2008 | Reis | |
| 8,079,380 | B2 * | 12/2011 | Engstrom | E04H 15/001 135/133 |
| 9,194,153 | B2 * | 11/2015 | Makos | E04H 15/38 |
| 9,238,924 | B2 * | 1/2016 | Wyant | E04H 15/001 |
| 9,512,632 | B2 * | 12/2016 | Cook | E04H 15/54 |
| 2012/0211042 | A1 * | 8/2012 | Richter | E04H 15/001 135/143 |
| 2014/0202509 | A1 | 7/2014 | Schamberger et al. | |
| 2016/0208513 | A1 * | 7/2016 | Ways | E04H 15/425 |

* cited by examiner

SLED-ATTACHED ICE SHELTER WITH FLEXIBLE AND RIGID POLE STRUCTURE

CLAIM FOR PRIORITY

This patent application claims the benefit of priority of Lonergan et al., U.S. Provisional Patent Application Ser. No. 62/127,171, entitled "SLED-ATTACHED ICE SHELTER WITH FLEXIBLE AND RIGID POLE STRUCTURE," filed on Mar. 2, 2015, which is hereby incorporated by reference herein in its entirety.

BACKGROUND

The present patent application relates to portable shelters typically used for sporting activities such as ice fishing and, more particularly, to expandable shelters configured to collapse into a sled.

Typical portable ice shelters are configured to expand in one of two ways. In the first configuration, a plurality of rigid arch members are pivotably connected to a rigid sled base. The rigid arch members have the general shape of the perimeter of the sled base. The rigid arch members can be pivoted from a stored position against the sled base to a deployed position in which they are spaced from each other at pivot points to support a skin shelter, or tent. Thus, the rigid arches approximately double the footprint of the sled base. In one such configuration, the rigid arch members are configured to change shape to slightly increase the footprint of the shelter, as is described in U.S. Patent Application Publication No. 2014/0202509 to Schamberger et al. In the second configuration, a sled base is not used and the skin shelter is supported by a pole structure that rests completely on the ice. One such ice shelter utilizes flexible poles, as is described in U.S. Pat. No. 7,320,332 to Reis. In either configuration, space is limited within the shelter, both vertically and horizontally, making fishing activities for anglers difficult. Additionally, these structures also result in loose skin panels that interfere with fishing activities and generate noise in windy conditions. Furthermore, other portable shelters that attempt to overcome these deficiencies result in bulky, heavy systems that are difficult to transport, deploy and set-up.

OVERVIEW

A portable ice shelter comprises a base, a rigid frame member, a multi-panel skin and a first set of flexible poles. The base comprises a bottom wall and a sidewall that forms an outer perimeter. The rigid frame member is pivotably mounted to the base at first and second locations, and is moveable between a stored position against the base and a deployed position angled from the base. The multi-panel skin is coupled to the rigid frame member, the multi-panel skin defining an enclosure when expanded. The first set of flexible poles extend from the rigid frame member, and each of the flexible poles in the first set is connected in an expandable fashion so as to expand at least a portion of the multi-panel skin when the rigid frame member is in the deployed position.

A method of deploying a portable ice shelter comprises partially removing an assembly of a first set of flexible poles and a skin structure from a stored position in a base, expanding the first set of flexible poles at a first hub assembly to form a first semi-free standing panel of the skin structure, and pivoting a rigid arch structure from a stored position against the base to a deployed position angled with respect to the base to partially support the skin structure.

DESCRIPTION OF DRAWINGS

FIGS. 8A-8G are schematic views of an exemplary sled-attached ice shelter being unpacked from a stored position and set-up into a deployed position.

DESCRIPTION

Figure 1:
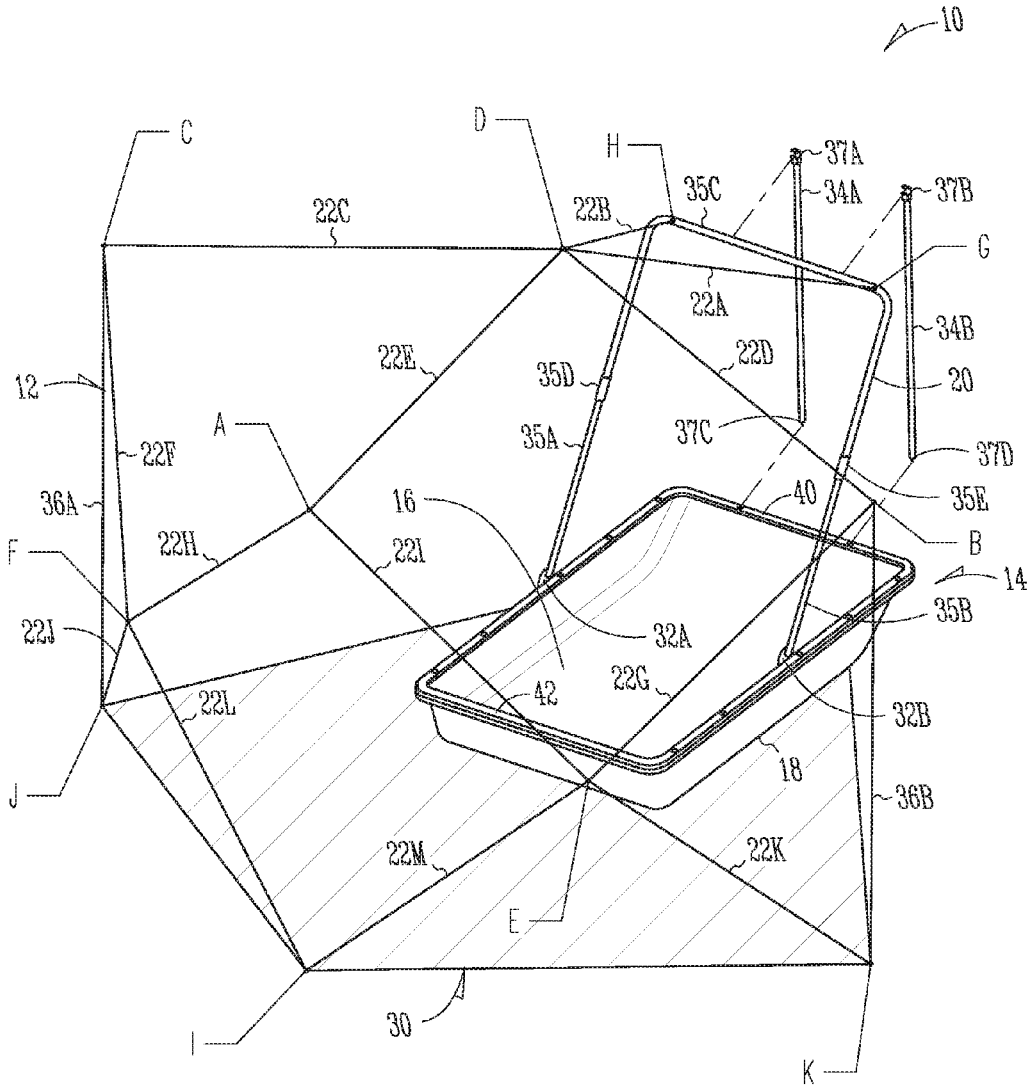
FIG. 1 is a perspective view of a 2-person, sled-attached ice shelter with a flexible and rigid pole structure in a deployed position.

FIG. 1 is a perspective view of 2-person, sled-attached ice shelter 10 with flexible and rigid pole structure 12 in a deployed position. Ice shelter 10 includes base 14 having bottom wall 16 and sidewall 18. Structure 12 includes frame member 20 and flexible poles 22A-22M.

Figure 2:
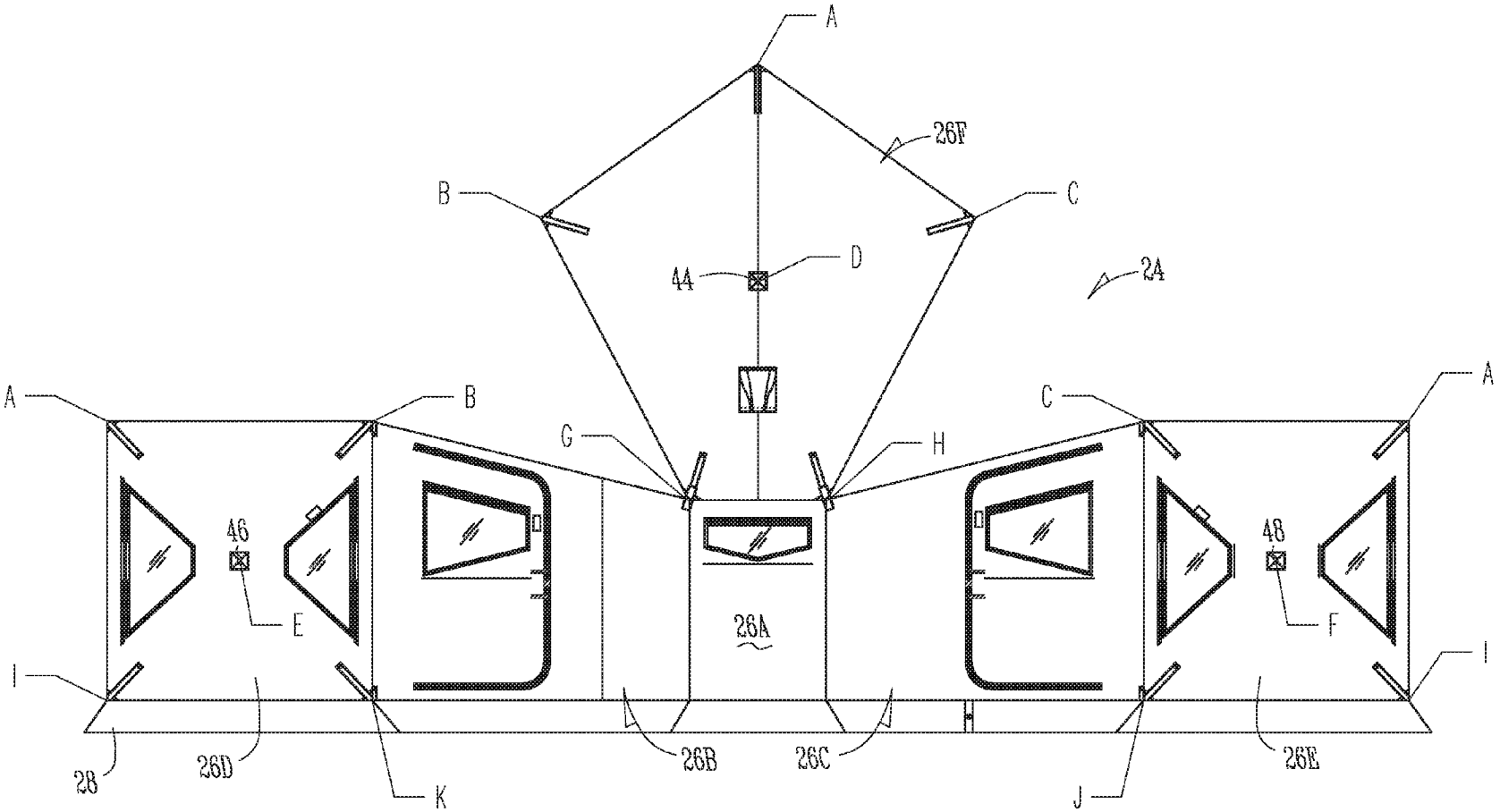
FIG. 2 is a plan view of an unfolded multi-panel skin structure configured to be joined to the flexible and rigid pole structure of FIG. 1.

FIG. 2 is a plan view of unfolded skin structure 24 configured to be joined to flexible and rigid pole structure 12 of FIG. 1. Skin structure 24 includes panels 26A-26F and skirt 28. Skin structure 24 also includes various windows, doors, access ports, as can be seen in FIG. 2 and FIGS. 7A and 7B.

Figure 3:
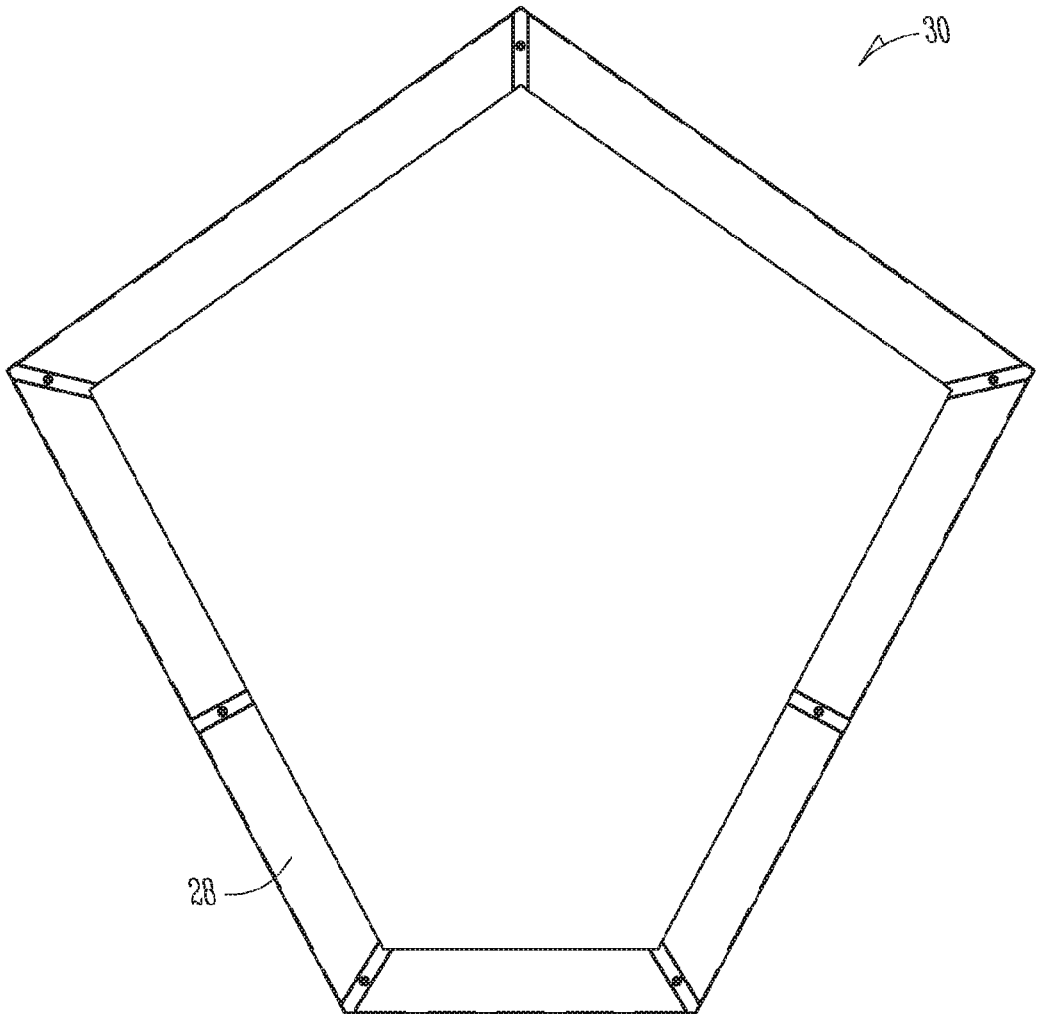
FIG. 3 is a plan view of a footprint produced by the skin structure of FIG. 2 when attached to the flexible and rigid pole structure of FIG. 1.

FIG. 3 is a plan view of footprint 30 produced by skin structure 24 of FIG. 2 when attached to flexible and rigid pole structure 12 of FIG. 1.

Figure 7A:
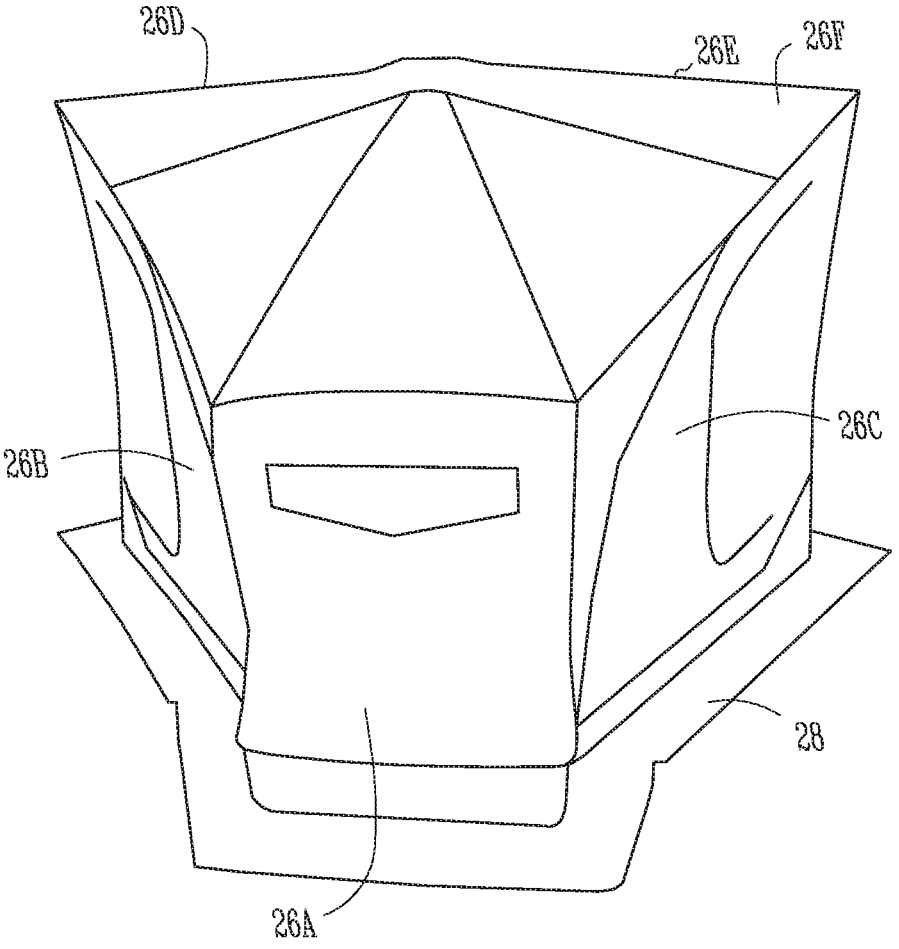
FIG. 7A is a back view of a 2-person, sled-attached ice shelter with the skin attached to the flexible and rigid pole structure.
Figure 7B:
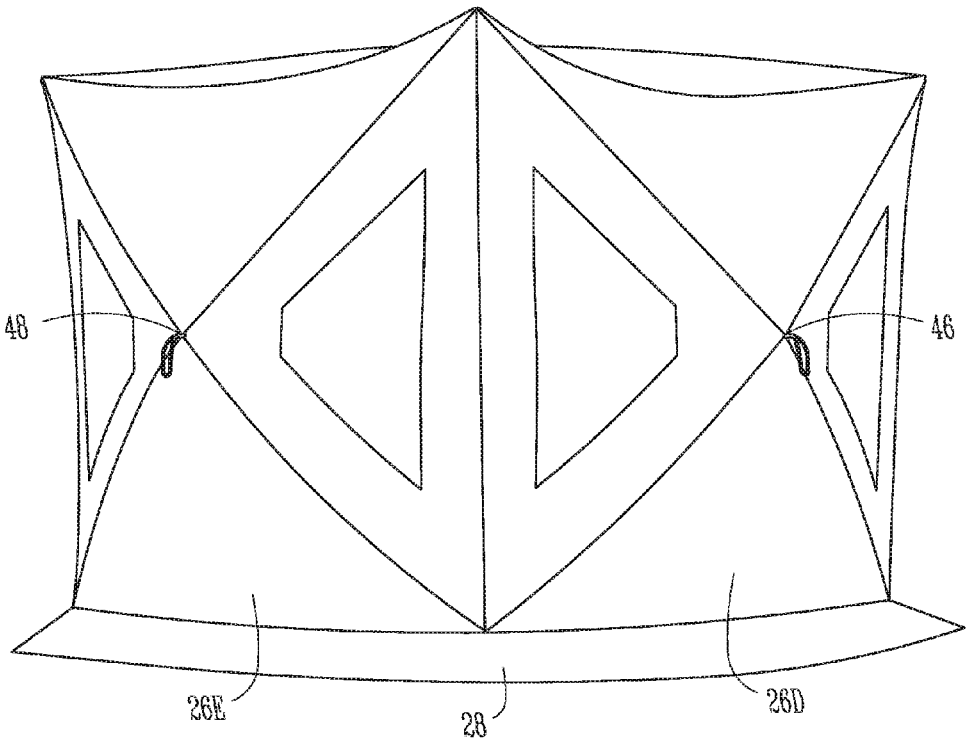
FIG. 7B is a front view of a 2-person, sled-attached ice shelter with the skin attached to the flexible and rigid pole structure.

FIGS. 7A and 7B shown panels 26A-26F of skin structure 24 fitted over flexible and rigid pole structure 12 in a deployed position.

With reference to FIG. 1, skin structure 24 (FIG. 2) is configured to cover rigid frame member 20 and flexible poles 22A-22M, but is not shown in FIG. 1 for illustrative purposes. Skin structure 24 mates with rigid frame member 20 and flexible poles 22A-22M at points A-I, as are shown in FIGS. 1 and 2. As such, panels 26A-26F envelope frame member 20 and flexible poles 22A-22M to form an enclosure when panels 26A-26M are connected at points A, B, C and I, as shown in FIGS. 7A and 7B. Skin structure 24 may be fabricated from any suitably pliable, rugged and lightweight material, such as nylon or the like.

Base 14 includes hinges 32A and 32B, and is also configured to connect to support poles 34A, 34B, 36A and 36B. Base 14 is configured as a sled wherein front end 40 of sidewall 18 is slanted with respect to bottom wall 16 in order to facilitate dragging of base 14 across a surface, such as snow covered ice. Base 14 is typically connected to a rope in order to facilitate towing or dragging of ice shelter 10 in the stored position. The remainder of sidewall 18, including rear end 42, is generally vertical, or perpendicular to bottom wall 16. Base 14 may be fabricated of any suitably material. Rigid, rugged and lightweight materials, such as plastic or aluminum, are desirable to facilitate ease of transportation of ice shelter 10. A folding seating assembly may be mounted on base 14, as described in the aforementioned U.S. Patent Application Publication No. 2014/0202509, which is hereby incorporated by this reference in its entirety.

Rigid frame member 20 comprises an arch-shaped, or U-shaped, pole or pole structure. In the described embodiment, rigid frame member can be comprised of telescoping portions 35A and 35B, and u-shaped portion 35C wherein telescoping portions 35A and 35B are configured to slide into and out of u-shaped portion 35. Telescoping portions 35A and 35B can be locked into place using collets 35D and 35E. In an alternative embodiment, rigid frame member 20 comprises a single-piece, three-sided U-shaped arch having three straight sections connected by arcuate sections.

Rigid frame member 20 is connected to base 14 at hinges 32A and 32B. As such, member 20 is pivotable about hinges 32A and 32B to lie flush against an upper rim or lip of sidewall 18, or to be disposed at an angle thereto. Member 20 can be supported in the angled position using poles 34A and 34B, which may be connected to structure 12 in a variety of ways, such as by sleeves sewn in skin structure 24 at panels 26B and 26C (FIG. 2), tie straps, ropes, hook and loop fastener material, or the like. In the depicted embodiment, poles 34A and 34B include clips 37A and 37B and points 37C and 37D, respectively. Clips 37A and 37B can comprise c-shaped members that grab onto u-shaped portion 35C of rigid frame member 20, while points 37C and 37D are positioned within holes in a lip on front end 40 of base 14. As such, poles 34A and 34B are mechanically supported in compression between member 20 and frame 14.

Figure 9:
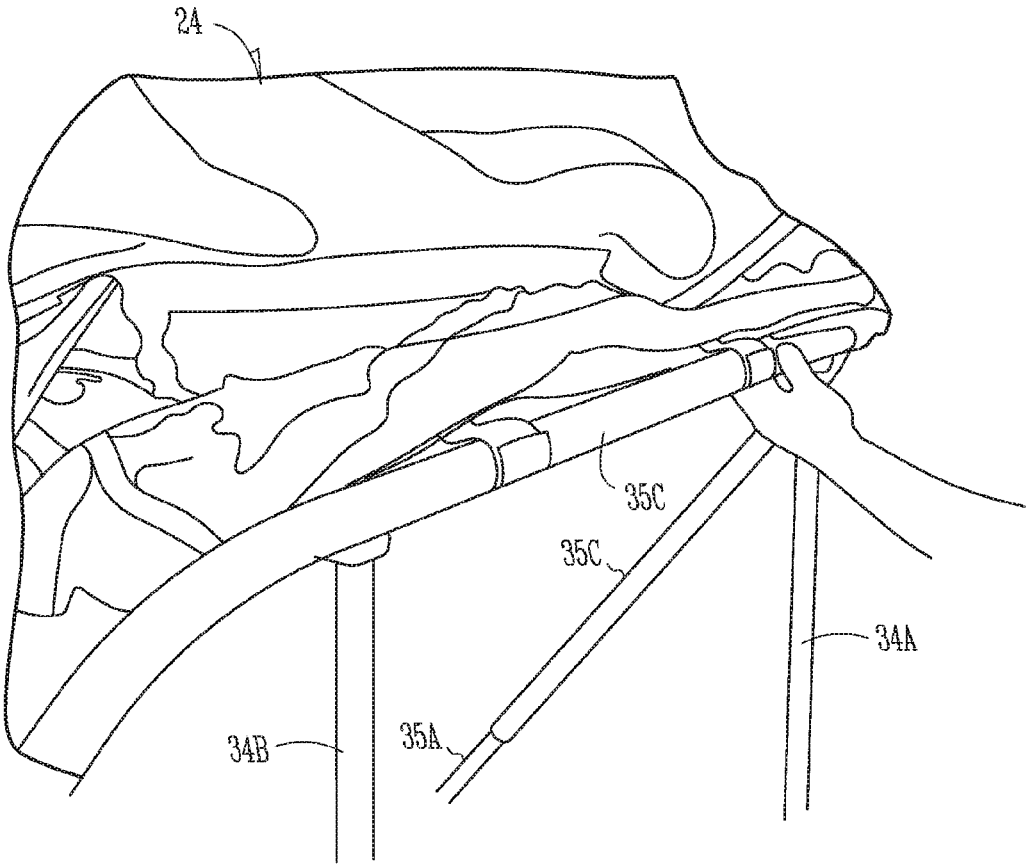
FIG. 9 is a schematic diagram showing a skin structure being attached to a pole structure via straps.

Skin structure 24 may be attached to rigid frame member 20 between hinge 32A and point H, between points G and H, and between point H and hinge 32B, such as by sleeves sewn at least partially around panel 26A (FIG. 2). Alternatively, skin structure 24 may be attached to rigid frame member 20 by tie straps, ropes, hook and loop fastener material, or the like. For example, FIG. 9 shows skin structure 24 being secured to rigid frame member 20 via hook and loop fastener straps. Skin structure 24 may additionally be secured to base 14 via edge trim members that clip edges of skin structure 24 to a lip on base 14. Flexible poles 22A and 22B are rotatably connected to rigid frame member 20 by the joining of skin structure 24 to rigid frame member 20. Rigid frame member 20 may be fabricated from any suitably stiff, rugged and lightweight material. In one embodiment, poles 34A and 34B are rigid and formed of the same material as member 20. In some embodiments, frame member 20 and poles 34A and 34B comprise steel or aluminum tubing bent in to the desired U-shape. Other suitably shaped unitary or telescoping frame members may be used in other embodiments.

Figure 10:
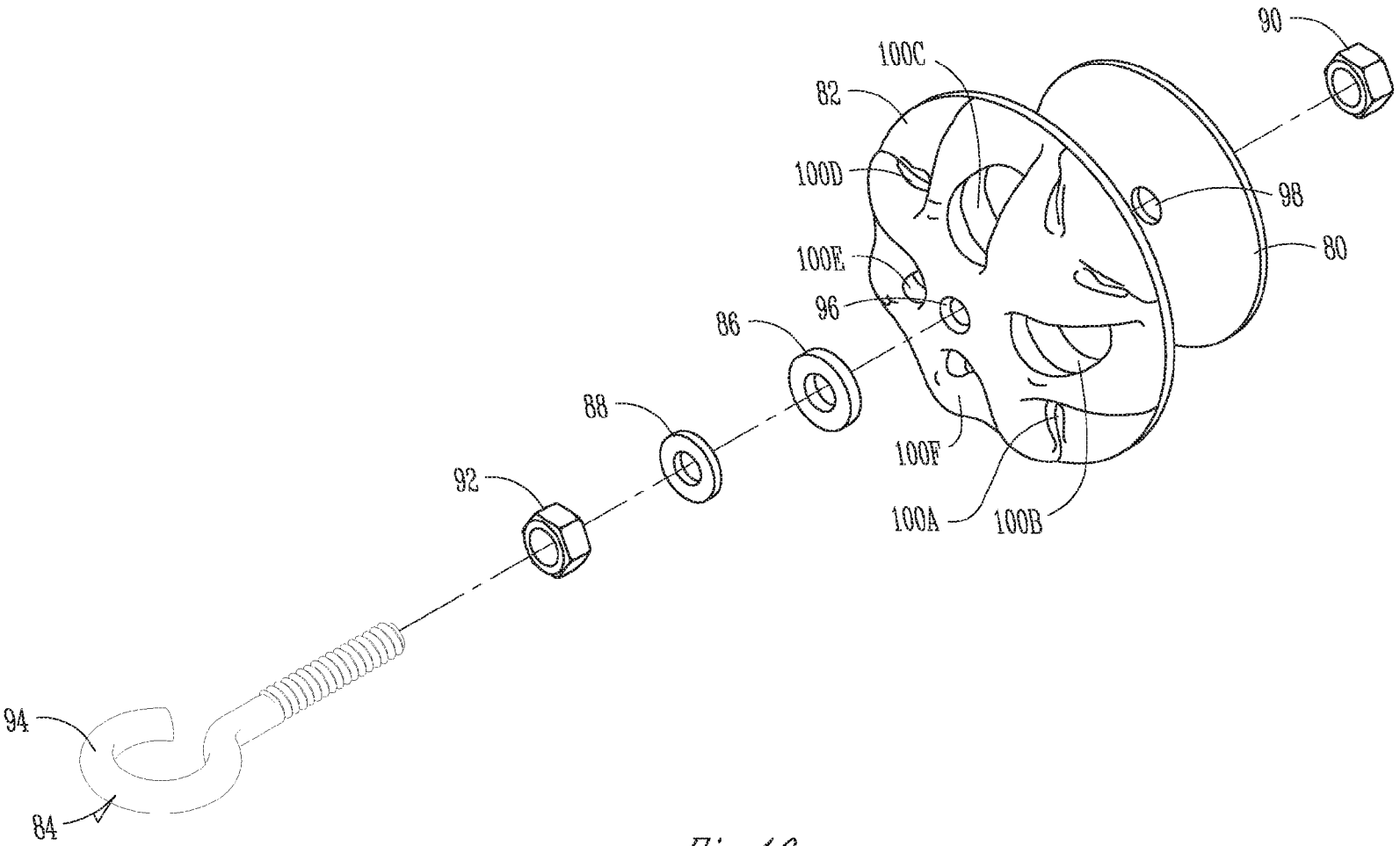
FIG. 10 is an exploded view of an exemplary hub assembly for use with various pole structures.

Flexible poles 22A-22M may be fabricated from any suitably flexible, rugged and lightweight material. In one embodiment, poles 22A-22M are fabricated from fiberglass, but may also be made from plastic or carbon fiber composite materials. Flexible poles 22A and 22B extend from rigid frame member 20 at points H and G and may be retained thereto by sleeves sewn into skin structure 24. In other embodiments poles 22A and 22B may be mechanically coupled to member 20 by fasteners or ball and socket joints. The opposite ends of poles 22A and 22B extend toward point D, which includes hub assembly 44 (see FIG. 2) that also receives ends of poles 22C, 22D and 22E. Hub assembly 44 may include rigid sleeves, or sockets, that receive the ends of the flexible poles. The rigid sleeves are also notable with respect to a base structure mounted to skin structure 24, such as by the use of fasteners extending through grommets within holes in skin structure 24 or the like. Ends of poles 22C, 22D and 22E opposite hub assembly 44 are supported by sleeves sewn into skin structure 24, or by tie straps or hook and loop fastener material, at points C, B and A on panel 26F (FIG. 2), for example. Hub assembly 44, including the rigid sleeves and base structure, may be fabricated from any suitable material such as plastic or metal. Hub assembly 44 may be configured to lock the rigid sleeves in place so that poles 22A-22E can be fixed in an extended state (e.g., in the deployed position of structure 12) as shown in FIG. 1. Hub assembly 44 would therefore also include a release mechanism that allows poles 22A-22E to be returned to the stored position. In one embodiment, hub assembly 44 includes detents that lock the rigid sleeves in place and a pull strap that retracts the detents to allow rotation from the locked position. In one embodiment, poles 22A-22E can includes spherical or ball-shaped tips that are joined to sockets within hub 44, as is shown in FIG. 10.

Skin structure 24 is also supported by two other hub assemblies 46 and 48 located at points E and F. Hub assembly 46 at point E supports flexible poles 22I, 22G, 22M and 22K. Hub assembly 48 at point F supports flexible poles 22F, 22H, 22J and 22L. Free ends of poles 22F-22M are supported by sleeves sewn into skin structure 24, or by tie straps or hook and loop fastener material, at points I, J and K on panels 26D and 26E (FIG. 2), for example. Hub assemblies 46 and 48 are constructed similarly to that of hub structure 44 and include base structures with rotatable rigid sleeves.

Skin structure 24 and flexible poles 22A-22M are additionally supported by poles 36A and 36B. Poles 36A and 36B may be connected to structure 12 in a variety of ways, such as by sleeves sewn in skin structure 24 at panels 26D and 26E (FIG. 2) between points B and K and C and J, respectively. Although other fastening means, such as tie straps, ropes, hook and loop fastener material, or the like, may be used. In one embodiment, poles 36A and 36B are flexible and formed of the same material as poles 22A-22M. In one embodiment, poles 36A and 36B each comprise collapsible poles having two or more flexible segments connected by rigid sleeve members. Alternatively, telescoping poles may be used to facilitate storing of poles 36A and 36B within base 14.

In the deployed position as shown in FIG. 1, skin structure 24 (FIG. 2) is configured to cover footprint 30 (FIG. 3). Skirt 28 (FIG. 2) extends from skin structure 24 to lie substantially flat against the surface upon which ice shelter 10 is deployed, e.g., ice of a frozen body of water. Skirt 28 may include grommets or the like for receiving stakes to hold skin structure 24 in place. Otherwise, the weight of skin structure 24 and flexible poles 22A-22M are enough to hold skin structure 24 in place via gravity. Skirt 28 may be divided into segments that are attached to each of the panels of skin structure 24, with each segment having flaps that overlap with flaps of adjacent segments.

In one embodiment, poles 22A-22M are longer than the length of material comprising skin structure 24 between the respective hub and sleeve between which each pole extends. As such, skin structure 24 must stretch to accommodate positioning of poles 22A- 22M in the deployed position. Skin structure 24 is thereby subjected to tension, which increases the useable space within shelter 10, and reduces noise generated by skin structure 24 in windy conditions.

In the stored or collapsed position, poles 34A, 34B, 36A and 36B are removed, and can be stored within base 14. Rigid frame member 20 is thus allowed to rotate to a position against sidewall 18. Thus, free ends of poles 22A-22E (i.e., ends not inserted into hub assembly 44 at point D) can be rotated to be proximate front end 40 of base 14, while hub assembly 44 at point D is positioned proximate rear end 42 of base 14. Likewise, free ends of poles 22I, 22G, 22M and 22K (i.e., ends not inserted into hub assembly 46 at point E) can be rotated to be proximate front end 40 of base 14, while hub assembly 46 at point E is positioned proximate rear end 42 of base 14. Also, free ends of poles 22F, 22H, 22J and 22L (i.e., ends not inserted into hub assembly 48 at point F) can be rotated to be proximate front end 40 of base 14, while hub assembly 48 at point F is positioned proximate rear end 42 of base 14. As such, all of poles 22A-22M can be disposed within the perimeter of sidewall 18. The free ends of poles 22A-22M may remain within the sleeves sewn into skin structure 24 when in both the deployed and stored positions.

FIGS. 8A-8G show an exemplary ice shelter being converted from the stored position to the deployed position. The process for converting an ice shelter from the deployed position to the stored position is completed by reversing the order of the steps shown in FIGS. 8A-8G. FIGS. 8A-8G are discussed with reference to 2-person, sled-attached ice shelter 10 and skin structure 24, however the steps discussed are applicable to 1-person, sled-attached ice shelter 50 and skin structure 74 of FIGS. 4 and 5.

FIG. 5A shows skin structure 24 being pulled out of base 14 and rigid frame member 20 being extended into an elongated position. In particular, u-shaped portion 35C is extended from telescoping portions 35A and 35B. Collets 35D and 35E can be loosed to allow for displacement of u-shaped portion 35C and then retightened once u-shaped portion 35C is in the desired location. In other embodiments, rigid frame member 20 does not include telescoping features and this step can be skipped during the deployment or storing process. Additionally, at this point any poles, such as poles 34A, 34B, 36A and 36B, can be removed from base 14.

Figure 8A:
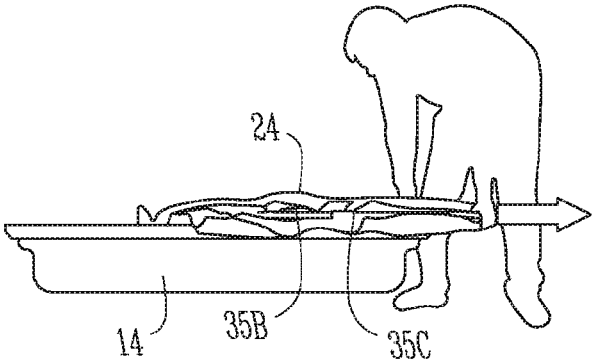
Figure 8B:
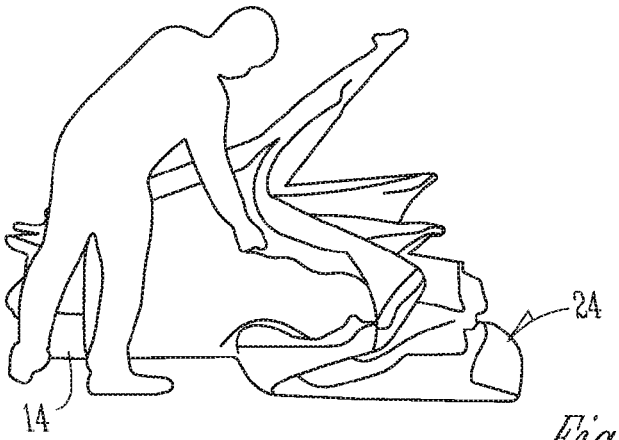

FIG. 8B shows skin structure 24 being further pulled from base 14. In order to deploy ice shelter 10 (i.e., to convert ice shelter 10 from the stored or collapsed position to the deployed position), material of skin structure 24 can be pulled from base 14 to access hub assemblies 46 and 48 at points E and F.

Figure 8C:
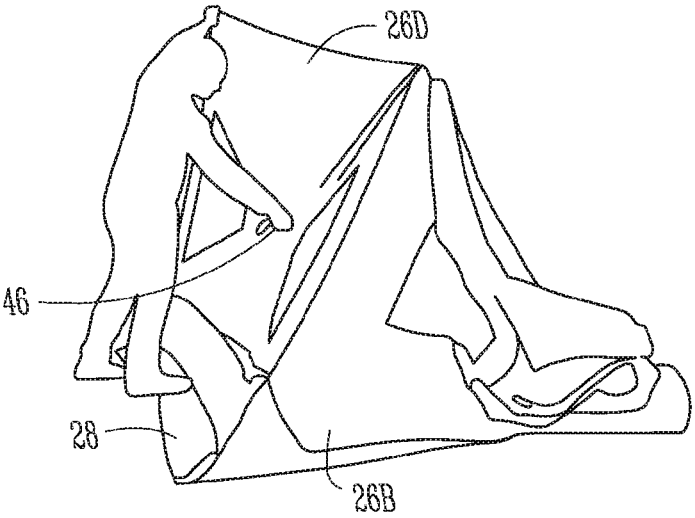

FIG. 8C shows front panels, such as panels 26D and 26E, being located and expanded. The respective poles can be rotated to extend from hub assemblies 46 and 48 to put skin structure 24 in tension. Thus, each of the sets of poles attached at hub assemblies 46 and 48 produces a semi-free standing panel forming a wall structure of the enclosure of ice shelter 10.

Figure 8D:
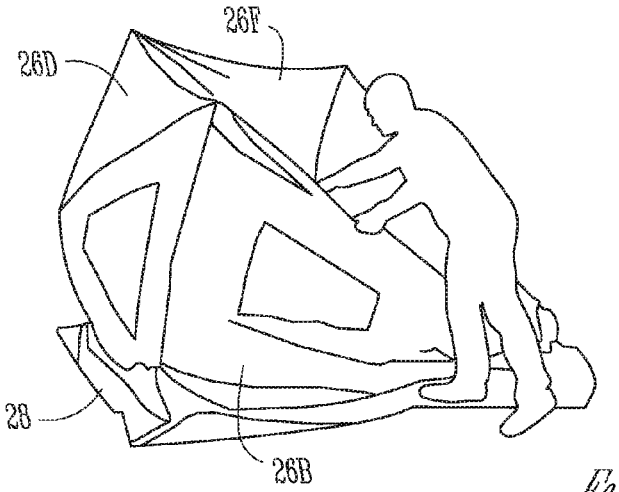

FIG. 8D shows a roof panel, such as panel 26F, being located and expanded. Subsequently, hub assembly 44 at point D (FIG. 2) is accessed and deployed to put skin structure in tension by extension of poles 22A-22E. Thus, a semi-free standing panel is produced forming a roof structure of the enclosure of ice shelter 10. After roof panel 26F and front panels 26D and 26E are extended, front panels 26D and 26E can be pulled or dragged away from base 14 to roughly form footprint 30 (FIG. 3).

Figure 8E:
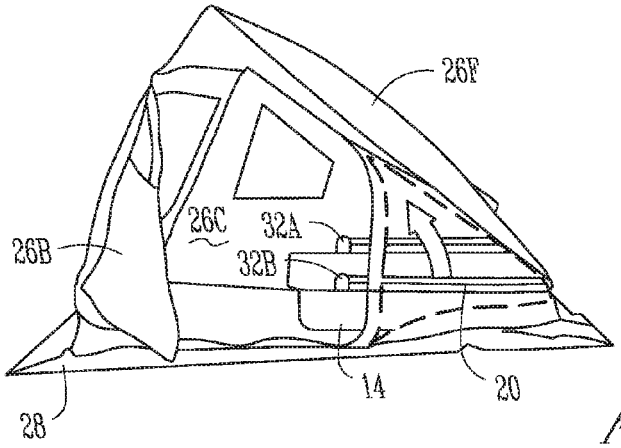

FIG. 8E shows rigid frame member 20 being rotated to an upward position to support skin structure 24. A user or operator of ice shelter 10 can access the interior of skin structure 74, such as by opening a door in panel 26B, such as by operating a zipper mechanism. Rigid frame member 20 can be accessed through the door opening and can be rotated at hinges 32A and 32B to form an angle with the upper rim of sidewall 18. Rigid frame member 20 can be semi-permanently supported by tension in skin structure 24 before poles 34A and 34B are put into place.

Figure 8F:
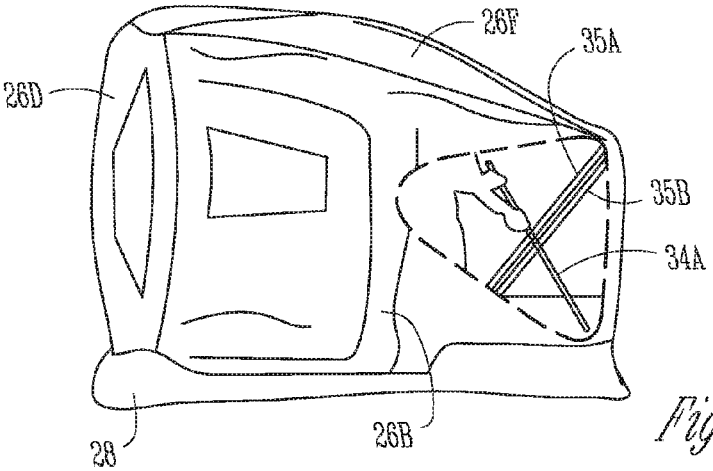
Figure 8C:
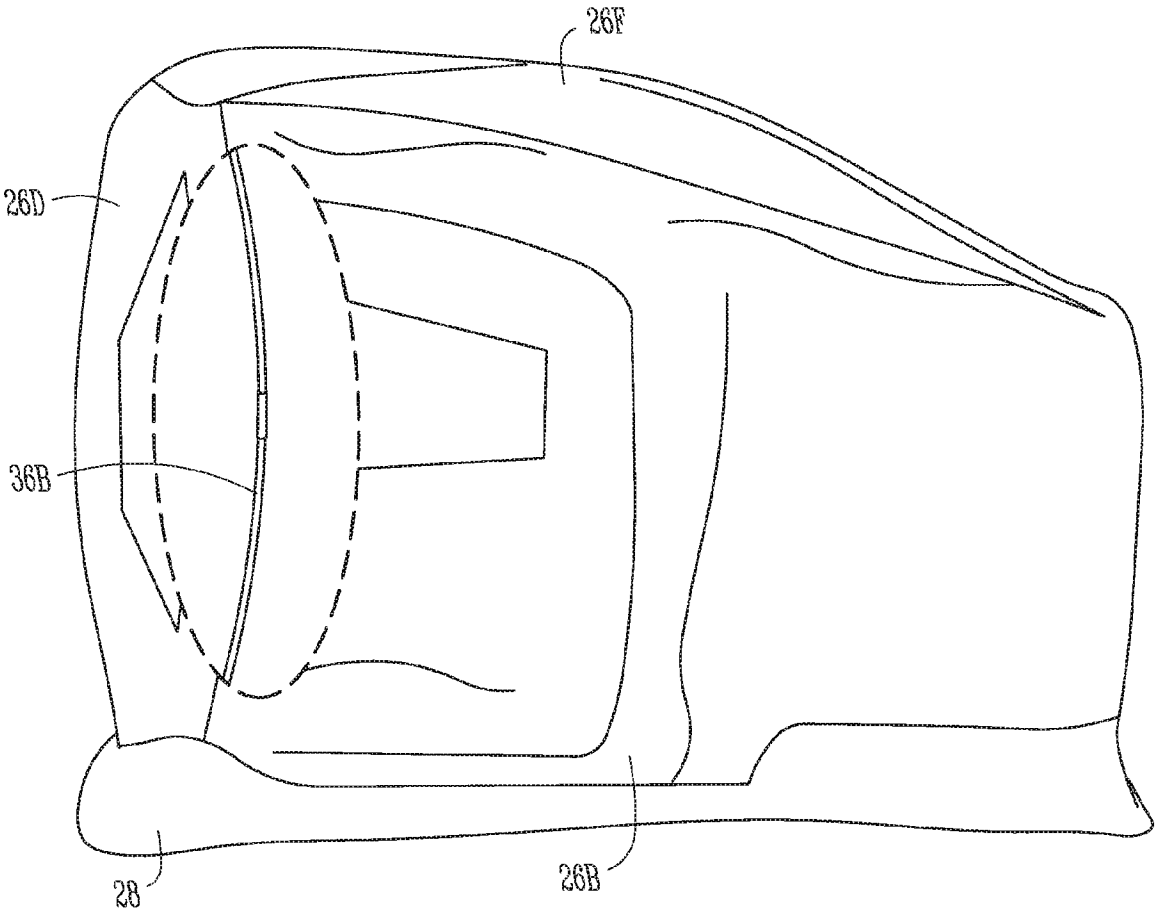

FIG. 8F shows poles 34A and 34B being located and placed. At such point an user or operator of ice shelter 10 can enter into skin structure 24 and stand on base 14. Poles 34A and 34B can be accessed within base 14 and positioned between sidewall 18 and rigid frame member 20 to support rigid frame member 20 in the angled position. Poles 34A and 34B can be secured in-place by any suitable means, such as by clipping ends of poles 34A and 34B onto rigid frame member 20 using clips 37A and 37B, and inserting points 37C and 37D at the opposite ends into notches or holes in front end 40 (FIG. 1). In other embodiments, opposite ends of poles can be inserted into holes in rigid frame member 20 and notches in sidewall 18.

FIG. 8G shows flexible poles 36A and 36B being located and placed. Again, with the user or operator of ice shelter 10 within skin structure 24, flexible poles 36A and 36B are positioned into place to support the semi-free standing roof structure opposite rigid frame member 20. Poles 36A and 36B can be secured in-place by any suitable means, such as inserting ends of the poles into sleeves within skin structure 24. Flexible poles 36A and 36B are optionally installed based on the user's discretion. For example, poles 36A and 36B can be used in windy conditions to provide additional tension to skin structure 24. As can be seen in FIG. 1, footprint 30 extends well beyond the perimeter of base 14 thereby providing are to move within ice shelter 10 in multiple directions from base 14.

Figure 4:
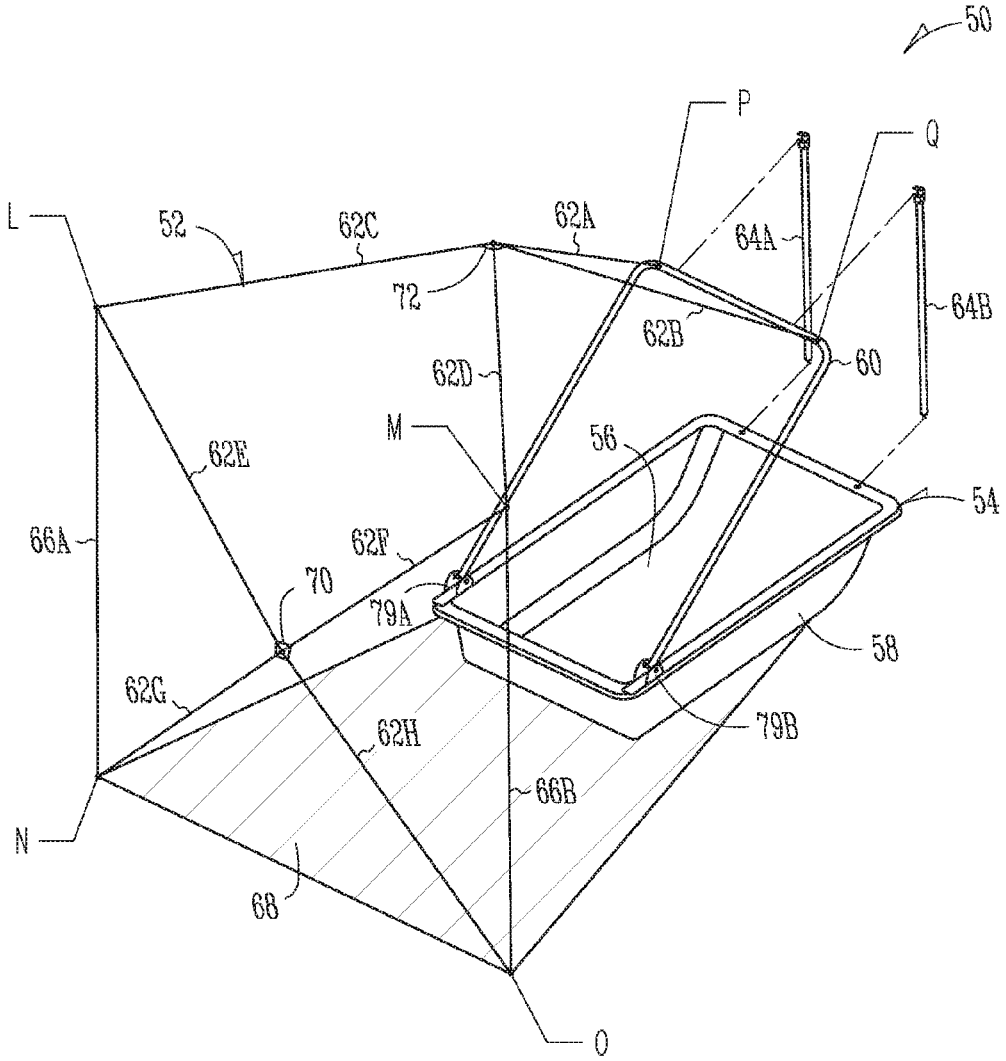
FIG. 4 is a perspective view of a 1-person, sled-attached ice shelter with a flexible and rigid pole structure in a deployed position.

FIG. 4 is a perspective view of 1-person sled-attached ice shelter 50 with flexible and rigid pole structure 52 in a deployed position.

Figure 5:
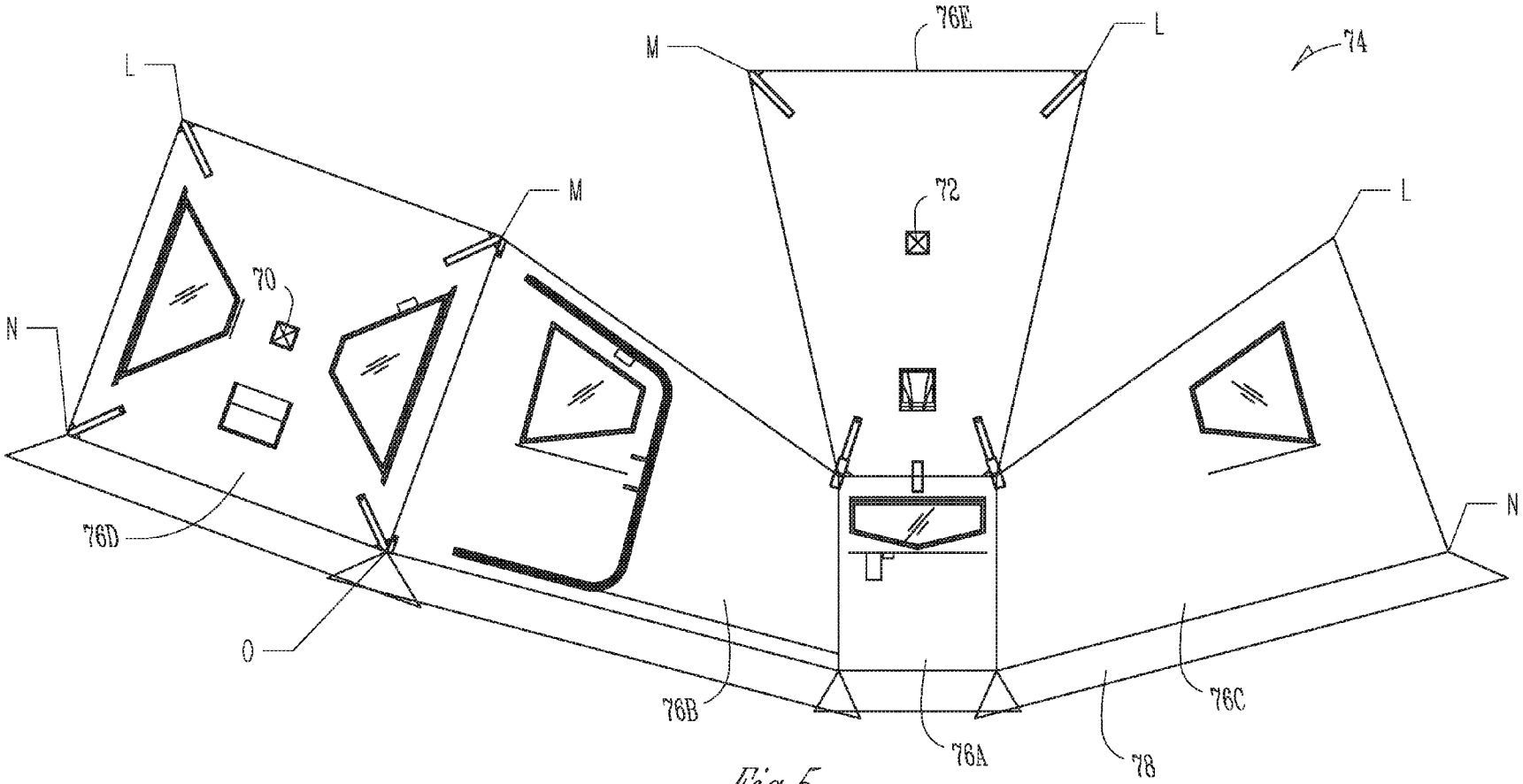
FIG. 5 is a plan view of an unfolded multi-panel skin structure configured to be joined to the flexible and rigid pole structure of FIG. 4.

FIG. 5 is a plan view of unfolded skin structure 74 configured to be joined to flexible and rigid pole structure 52 of FIG. 4.

Figure 6A:
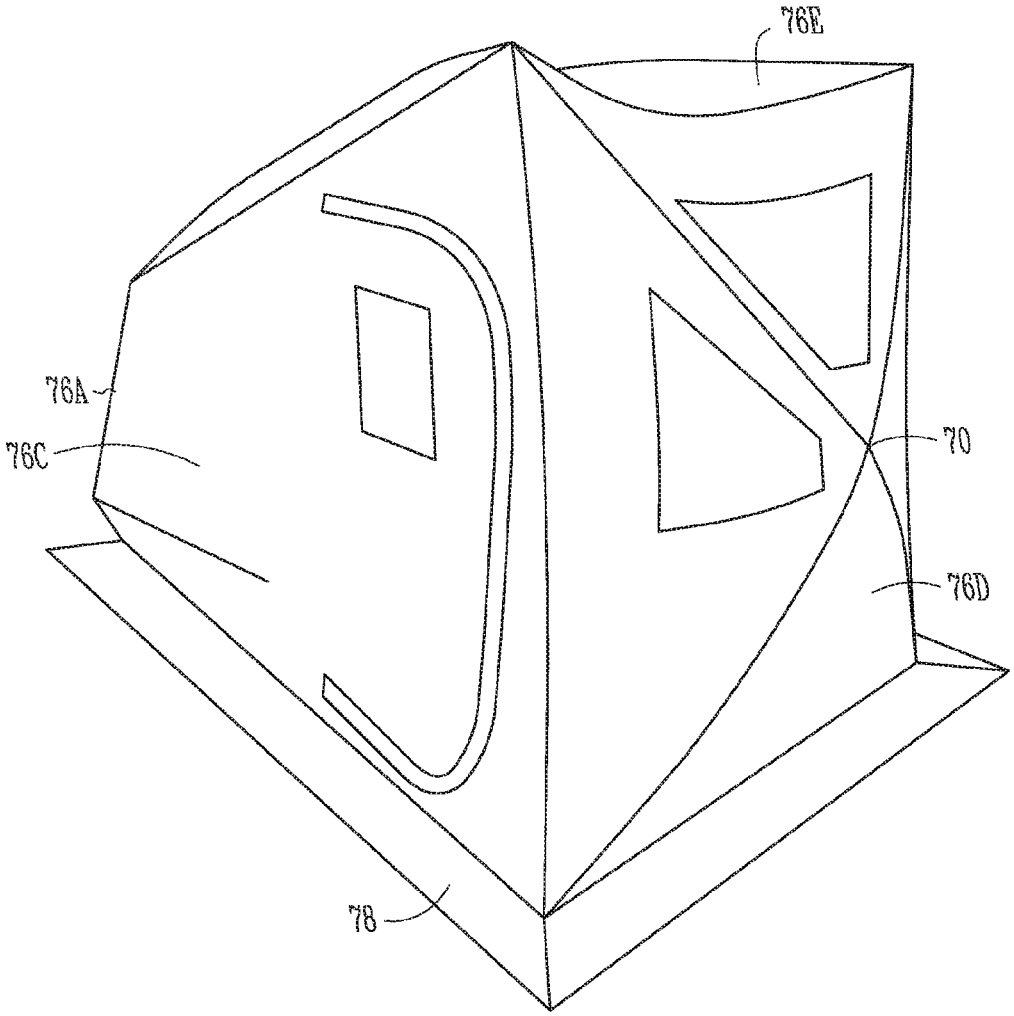
FIG. 6A is a right-front perspective view of a 1-person, sled-attached ice shelter with the skin attached to the flexible and rigid pole structure.
Figure 6B:
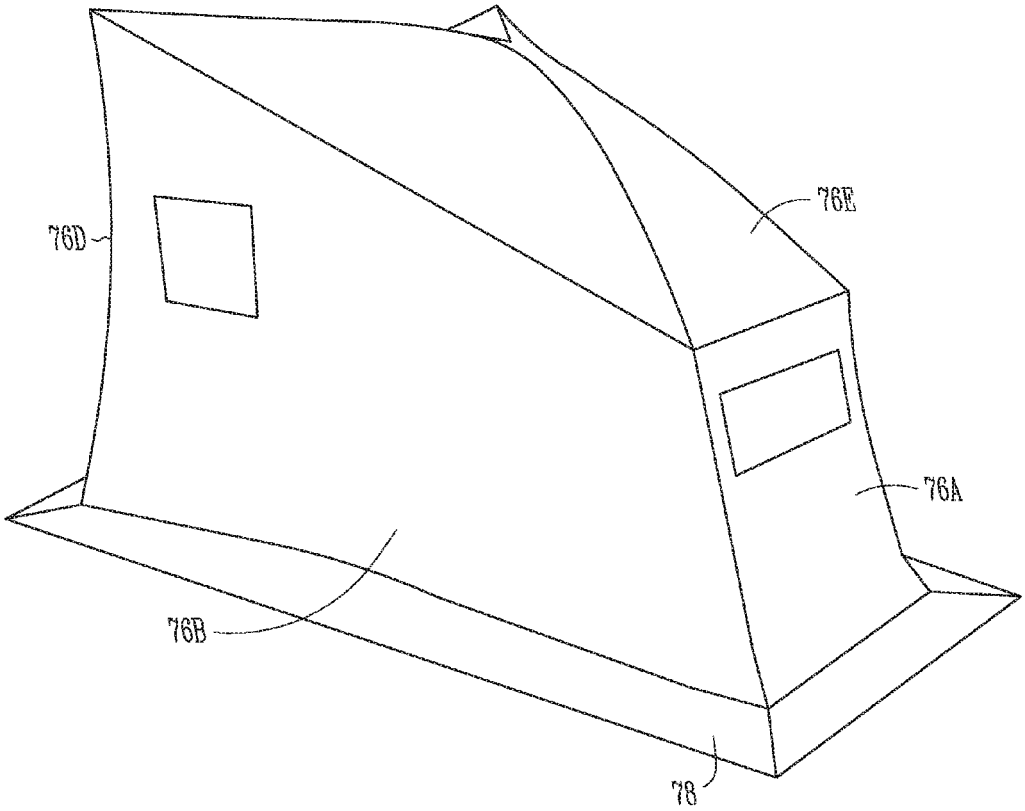
FIG. 6B is a back-left perspective view of a 1-person, sled-attached ice shelter with the skin attached to the flexible and rigid pole structure.

FIGS. 6A and 6B shown panels 66A-66F of skin structure 74 fitted over flexible and rigid pole structure 52 in a deployed position.

Skin structure 74 includes panels 76A-76E and skirt 78. Skirt 78 may be divided into segments that are attached to each of the panels of skin structure 74, with each segment having flaps that overlap with flaps of adjacent segments. Skin structure 74 also includes various windows, doors, access ports, as can be seen in FIGS. 6A and 6B.

Ice shelter 50 includes base 54 having bottom wall 56 and sidewall 58, as well as hinges 79A and 79B. Structure 52 includes rigid frame member 60 and flexible poles 62A-62H. Ice shelter 50 also includes rigid poles 64A and 64B, and flexible poles 66A and 66B. In one embodiment, structure 52 can be set up and utilized with only one of poles 64A and 64B. Rigid frame member 60 and flexible poles 62A-

62H are configured to support a multi-panel skin structure that forms an enclosure having footprint 68 that encompasses base 54.

Ice shelter 50 is constructed in a similar fashion to that of ice shelter 10 of FIGS. 1-3 except ice shelter 50 includes two four-pole hub assemblies 70 and 72. First ends of flexible poles 62E-62H connect to hub assembly 70 and second ends of flexible poles 62E-62H connect to the skin structure in sleeves at points L-O. First ends of flexible poles 62A-62D connect to hub assembly 72 and second ends of flexible poles 62A-62D connect to skin structure 74 in sleeves at points L, M, P and Q. Flexible poles 62E-62H are expanded to form a first semi-free standing panel forming a sidewall structure. Flexible poles 62A-62D are expanded to form a second semi-free standing panel forming a roof structure. As can be seen in FIG. 4, footprint 68 extends well beyond the perimeter of base 54 thereby providing are to move within ice shelter 50 in multiple directions from base 54.

FIG. 10 is an exploded view of an exemplary hub assembly, such as hub assembly 44, for use with various pole structures. The hub assembly includes back plate 80, socket plate 82, fastener 84, resilient washer 86, rigid washer 88, and nuts 90 and 92. Nut 92 can be threaded onto fastener 84 toward eyelet 94. Washers 88 and 86 can then be fitted over fastener 84 against nut 92. Washer 86 may be fabricated from a resilient material, such as rubber, to provide tension to the assembled hub and prevent nuts 92 from unthreading from fastener 84. Washer 88 can be rigid to allow nut 92 to compress resilient washer 86. Fastener 84 is then inserted into openings 96 and 98 in socket plate 82 and back plate 80, respectively. Nut 90 can then be threaded onto fastener 84 and tightened down to secure hub assembly together. Nut 90 can be a lock nut, such as a Nyloc nut to prevent loosening of the hub during use.

Socket plate 82 includes six sockets 100A-100F for receiving ball ends that can be attached to ends of rigid poles for forming pole structures 12 and 52. Without back plate 80 secured to socket plate 82, the elongate portions of the poles can be inserted into socket plate 82 through sockets 100A-100F until the ball ends reach the sockets. Back plate 80 can then be secured to socket plate 82 to trap the ball ends in sockets 100A-100F. However, the ball ends are still permitted to rotate within sockets 100A-100F to permit the poles to fold in axial positions parallel to fastener 84 or radial positions perpendicular to fastener 84.

What is claimed is:

1. A portable ice shelter comprising:

a base comprising a bottom wall and a sidewall that forms an outer perimeter;

a rigid frame member pivotably mounted to the base at first and second locations, the rigid frame merriber moveable between a stored position against the base and a deployed position angled from the base;

a multi-panel skin coupled to the rigid frame member, the multi-panel skin defining an enclosure when expanded; and a first set of flexible poles extending from the rigid frame member, each of the flexible poles in the first set being connected in an expandable fashion so as to expand at least a portion of the multi-panel skin when the rigid frame member is in the deployed position;

wherein first ends of at least four flexible poles in the first set of flexible poles are pivotably connected to a hub such that second ends of the at least four flexible poles are rotatable toward each other.

2. The portable ice shelter of claim 1, wherein the first set of flexible poles is configured to impart tension in the skin.

3. The portable ice shelter of claim 2, wherein a length of at least one of the flexible poles in the first set is longer than a length of the skin between ends of the at least one pole when the skin is unstressed.

4. The portable ice shelter of claim I, wherein two of the flexible poles in the first set of flexible poles are connected to the rigid frame member at rotatable connections.

5. The portable ice shelter of claim 1, wherein the rigid frame member is pivotably mounted to the base at first and second hinges at the first and second locations, respectively.

6. The portable ice shelter of claim 1, wherein the second ends of the at least four flexible poles are connected to the multi-panel skin.

7. The portable ice shelter of claim 6, wherein the second ends of the at least four flexible poles are connected to the multi-panel skin at sleeves defined at least partially by the multi-panel skin.

8. The portable ice shelter of claim 1, wherein flexible poles of the first set of flexible poles are constructed of fiberglass rods.

9. The portable ice shelter of claim 1, wherein the rigid frame member is constructed of metal tubing.

10. The portable ice shelter of claim I, further comprising a rigid support pole configured to extend between the rigid frame member and the base when the rigid frame member is in the deployed position.

11. The portable ice shelter of claim 1, further comprising a flexible support pole extending across the multi-panel skin in proximity to the first set of flexible poles.

12. The portable ice shelter of claim 1, further comprising a skirt surrounding a perimeter of the multi-panel skin, the skirt including holes having grommets.

13. The portable ice shelter of claim 1, further comprising a second set of flexible poles configured to form a semi-free standing wall structure of the multi-panel skin.

14. The portable ice shelter of claim 1, further comprising a second set of flexible poles configured to form a semi-free standing roof structure of the multi-panel skin.

15. A method of deploying a portable ice shelter, the method comprising:

partially removing an assembly of a first set of flexible poles and a skin structure from a stored position in a base;

expanding the first set of flexible poles at a first hub assembly to form a first semi-free standing panel of the skin structure; and pivoting a rigid arch structure from a stored position against the base to a deployed position angled with respect to the base to partially support the skin structure.

16. The method of claim 15, further comprising:

inserting a rigid pole between the base and the rigid arch structure to support the rigid arch structure in the deployed position.

17. The method of claim 16, further comprising:

positioning a flexible pole alongside the skin structure to support the first semi-free standing panel.

18. The method of claim 15, further comprising expanding a second set of flexible poles at a second hub structure to form a second semi-free standing panel of the skin structure.

19. The method of claim 18, wherein the first semi-free standing panel forms a wall structure and the second semi-free standing panel forms a roof structure.

20. A portable ice shelter comprising:

a base comprising a bottom wall and a sidewall that forms an outer perimeter;

a rigid frame member pivotably mounted to the base at first and second locations, the rigid frame member moveable between a stored position against the base and a deployed position angled from the base;

a multi-panel skin coupled to the rigid frame member, the multi-panel skin defining an enclosure when expanded;

a first set of flexible poles extending from the rigid frame member, each of the flexible poles in the first set being connected in an expandable fashion so as to expand at least a portion of the multi-panel skin when the rigid frame member is in the deployed position; and a second set of flexible poles configured to form a semi-free standing roof structure of the multi-panel skin.

* * * * *